US006042221A

United States Patent [19]

Komuro

[11] Patent Number: 6,042,221

[45] **Date of Patent: *Mar. 28, 2000**

[54] INK-JET RECORDING HEAD AND INK-JET RECORDING APPARATUS

[75] Inventor: Hirokazu Komuro, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/671,954

[22] Filed: Jun. 28, 1996

[30] Foreign Application Priority Data

Jun. 30, 1995 [JP] Japan ..... 7-166104

[51] Int. Cl.[7] ..... B41J 2/05

[52] U.S. Cl. ..... 347/62; 347/64

[58] Field of Search ..... 347/62, 64, 202

[56] References Cited

U.S. PATENT DOCUMENTS

| | | | |
|---|---|---|---|
| 4,313,124 | 1/1982 | Hara | 347/57 |
| 4,339,762 | 7/1992 | Shirato et al. | 346/140 R |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,860,033 | 8/1989 | Shiozaki et al. | 347/64 |
| 4,881,318 | 11/1989 | Komuro et al. | 29/827 |
| 4,935,752 | 6/1990 | Hawkins | 347/62 |
| 4,947,189 | 8/1990 | Braun et al. | 347/62 |
| 5,293,182 | 3/1994 | Sekiya et al. | 346/140 R |
| 5,322,811 | 6/1994 | Komuro et al. | 438/21 |
| 5,479,197 | 12/1995 | Fujikawa et al. | 347/63 |
| 5,485,185 | 1/1996 | Sueoka et al. | 347/64 |
| 5,491,505 | 2/1996 | Suzuki et al. | 347/203 |
| 5,559,543 | 9/1996 | Komuro | 347/62 |

FOREIGN PATENT DOCUMENTS

| | | |
|---|---|---|
| 0318981 | 6/1989 | European Pat. Off. . |
| 0318982 | 6/1989 | European Pat. Off. . |
| 0372097 | 6/1990 | European Pat. Off. . |
| 0446918 | 9/1991 | European Pat. Off. . |
| 54-051837 | 4/1979 | Japan . |
| 55-126462 | 9/1980 | Japan . |
| 58-33471 | 2/1983 | Japan . |
| 59-123670 | 7/1984 | Japan . |
| 59-138461 | 8/1984 | Japan . |
| 60-236758 | 11/1985 | Japan . |
| 63-191645 | 8/1988 | Japan . |
| 1-46769 | 2/1989 | Japan . |
| 2-55131 | 2/1990 | Japan . |
| 5-31900 | 2/1993 | Japan . |

*Primary Examiner*—N. Le
*Assistant Examiner*—Anh T. N. Vo
*Attorney, Agent, or Firm*—Fitzpatrick, Cella, Harper & Scinto

[57] ABSTRACT

An ink-jet recording head comprises an ink flow path having a discharge opening for discharging an ink, a lower layer for heat accumulation, a resistance layer provided on the lower layer, a pair of wiring electrodes provided on the resistance layer for applying an electric signal to the resistance layer, and an electrothermal transducer, provided corresponding to the ink flow path, employing the resistance layer between the wiring electrodes as a heat-generating portion, wherein the heat-generating portion has a high temperature section and a low temperature section when driven, and a boundary at which the thickness of the protective layer varies is positioned on the low temperature section.

15 Claims, 11 Drawing Sheets

INK-JET RECORDING HEAD AND INK-JET RECORDING APPARATUS

BACKGROUND OF THE INVENTION

1. Field of the Invention

The present invention relates to an ink-jet recording head, and an ink-jet recording apparatus employing the ink-jet recording head.

2. Related Background Art

The ink-jet recording system as disclosed, for example, in Japanese Patent Application Laid-Open No. 54-51837, has characteristics different from other ink-jet recording systems in that the driving force of the discharging of liquid droplets is derived by application of thermal energy to the liquid. More specifically, in the ink-jet recording method disclosed in the above Laid-Open gazette, a liquid is heated by application of thermal energy to form a bubble, and the liquid droplet is discharged, by action of the force generated by bubble formation, through a discharge opening at the tip portion of the recording head to be allowed to deposit onto a receding medium to record information thereon.

The ink-jet recording head (hereinafter simply referred to as a "recording head") employed in the ink-jet recording system is provided with a liquid discharge portion. The liquid discharge portion generally comprises a discharge opening for discharging the liquid, a liquid path communicating with the discharge opening, and a heat-generating means provided in the liquid path for applying the thermal energy to the liquid. An example of the heat-generating means is an electrothermal transducer which comprises a lower layer for heat accumulation, a resistance layer having a heat-generating portion, a pair of wiring electrodes for supplying electricity to the resistance layer, and a protective layer for protecting the wiring electrodes against the ink.

From the standpoint of design of the recording head, the protective layer is preferably formed as thin as possible, or more preferably not formed, in order to transfer the thermal energy effectively to the ink. However, in conventional recording heads, the protective layer had to be formed thick on and around the border portion between the heat-generating portion and the wiring electrodes to protect the wiring electrode, because the wiring electrodes are formed thick to decrease the electric resistance with a large height of the electrode pattern.

On the other hand, the resistance layer is relatively thin in comparison with the wiring electrodes since the resistance layer has high electric resistance. Accordingly, the protective layer can be made thin at the heat-generating portion of the resistance layer (the region of the resistance layer which is between the pair of wiring electrodes and has no wiring electrode built up thereon).

Japanese Patent Application Laid-Open No. 60-236758 proposes formation of the protecting layer to be thin at the heat-generating portion. However, it does not specifically consider where the protective layer is to be thinned.

Japanese Patent Application Laid-Open No. 63-191645 discloses wiring electrodes provided beneath the resistance layer at an organic protective layer portion covering the heat-generating portion to decrease the temperature rise of the organic protective layer portion since the organic protective layer is less heat-resistant. However, this arrangement is employed in consideration of the durability of the protective layer, but the relation with the resistance layer is not considered.

Japanese Patent Application Laid-Open No. 55-126462 discloses a layer constitution having no protective layer. The resistance layer in such a layer constitution should have sufficient ink resistance, having excellent electrochemical properties at a high temperature, and being resistant against cavitation caused on bubble disappearance. The suitable material for the resistance layer having the above properties include Al-Ta-Ir disclosed in Japanese Patent Application Laid-Open No. 1-46769, and Ta-Ir disclosed in Japanese Patent Application Laid-Open No. 2-55131.

However, in the recording head which has a protective layer thinner at the heat-generating portion, the discharge durability varies depending on the thickness of the protective layer, and may be inferior in discharging characteristics.

The inferior discharging characteristics are found to result from the causes below by failure analysis. The first cause is that a crack appears at the thin portion of the protective layer, and ink penetrates through the formed crack to react with the resistance layer at a high temperature to destroy it. The second cause is that the thermal stress of the protective layer against the resistance layer breaks the resistance layer at the thin portion of the protective layer. More specifically, the protective layer is formed relatively thicker on the wiring electrode layer to cover the level difference of the electrode pattern, and is formed as thin as possible on the heat-generating portion. Therefore, the thick region and the thin region of the protective layer exist on the heat-generating portion on and around the pattern boundary of the heat-generating portion and the wiring electrode (see FIGS. 9A and 9B). When the heat-generating portion of the resistance layer generates heat, heat expansion difference between the thick region and the thin region of the protective layer impose stress between those regions to cause cracking of the protective layer, or to damage the lower resistance layer to destroy finally the resistance layer by high-temperature reaction with ink having penetrated through the crack of the protective layer. Otherwise the resistance layer under the boundary of the thick portion and the thin portion of the protective layer may be broken by the aforementioned stress of protective layer.

In particular in the present invention, an ink-jet system is employed which discharges ink by pressure of film-boiling of the ink, and the heat is generated abruptly in a very short time in the heat-generating portion of the resistance layer to impose great heat stress to the upper protective layer. The stress is stronger at the portion where the thickness of the protection is changed.

On the other hand, in the similar ink discharge test using a recording head in which the heat-generating portion of the resistance layer is brought into direct contact with the ink (namely, no protective layer on the heat-generating portion, see FIGS. 10A and 10B), the durability varies around the boundary between the protected and the unprotected regions, similarly in the recording head having a protective layer.

As the result of the failure analysis, the first cause is the large difference of stress in the protective layer between the protected and the unprotected regions of the resistance layer on heat generation to break the resistance layer, similarly as the aforementioned second cause. The second cause in this case is electrochemical reaction. In particular, when the resistance layer is made thinner to raise the sheet resistance for weaker current drive for the purpose of using an inexpensive driving element, the potential difference in the resistance layer becomes larger, which accelerates the electrochemical reaction to cause breakdown of the resistance layer in a short time.

The breakdown of the resistance layer by electrochemical reaction is considered below for a layer constitution in which the heat generating portion is brought into direct contact with the ink. The breakdown of the resistance layer by the electrochemical reaction is considered to result from the causes below:

(1) Attack by alkali metal ions against the negative electrode portion: The resistance layer and the heat accumulation layer are liable to be attacked by electrochemical reaction especially at the end portion of the resistance layer pattern, and (2) Dissolution of the resistance layer at the positive electrode portion.

The electrochemical reaction is accelerated by the factors below:

(i) Voltage: A higher driving voltage for the resistance layer increases the potential difference in the heat-generating portion, accelerating the electrochemical reaction.

(ii) Temperature: A higher temperature naturally accelerates the reaction, since the electrochemical reaction is a kind of chemical reaction. This depends on the ratio of the driving voltage to the bubble formation voltage and the driving pulse width.

(iii) Heating time: The progress of the electrochemical reaction depends on the heating time within one pulse, or the driving pulse width.

(iv) Kind of ink: The electrochemical reaction is naturally affected by the ion species contained in the ink.

(v) Material and thickness of resistance layer: The electrochemical reaction naturally depends on the material of the resistance layer. The time passed before the breakdown depends on the layer thickness. The larger the thickness, the longer the time passed before breakdown.

The progress of the electrochemical reaction varies with the above causes. In particular, in weaker electric current drive with a less expensive driving element to reduce cost, a higher sheet resistance is required for the resistance layer, which lowers the discharge durability.

The lower durability at the higher sheet resistance is considered as follows. The higher sheet resistance increases the potential difference in the resistance layer to accelerate the electrochemical reaction. The less thickness of the resistance layer results in poorer anti-electrochemical reaction properties. These two causes can lower the ejection durability.

Furthermore, the electrochemical reaction is accelerated by various factors such as a higher driving voltage with a certain pattern design of the resistance layer; higher maximum temperature of the resistance layer owing to variation in production of the recording heads at a driving voltage uniformized for cost reduction; and use of various ink for various recording paper. Therefore, a layer material and a layer constitution is required which are more stable electrochemically.

As described above, a measure is required to meet the change of the protective layer thickness on the heat-generating portion in order to improve the discharge durability irrespectively of the presence or absence of the protective layer on the heat-generating portion of the resistance layer.

SUMMARY OF THE INVENTION

An object of the present invention is to provide an ink-jet recording head which exhibits excellent discharge durability independently of the kind of ink and is producible at a lower cost without the above-mentioned disadvantages.

Another object of the present invention is to provide an ink-jet recording apparatus employing the above ink-jet recording head.

According to an aspect of the present invention, there is provided an ink-jet recording head comprising an ink flow path having a discharge opening for discharging an ink, a lower layer for heat accumulation, a resistance layer provided on the lower layer, a pair of wiring electrodes provided on the resistance layer for applying an electric signal to the resistance layer, and an electrothermal transducer, provided corresponding to the ink flow path, employing the resistance layer between the wiring electrodes as a heat-generating portion, wherein the heat-generating portion has a high temperature section and a low temperature section when driven, and a boundary at which the thickness of the protective layer varies is positioned on the low temperature section.

In an embodiment of the ink-jet recording head, the high temperature section and the low temperature section are provided by making nonuniform the width of the resistance layer forming the heat-generating portion.

In another embodiment of the ink-jet recording head, the high temperature section and the low temperature section are provided by making nonuniform the thickness of the resistance layer forming the heat-generating portion.

In still another embodiment of the ink-jet recording head, the high temperature section and the low temperature section are provided by making nonuniform the thickness of the lower layer corresponding to the heat-generating portion.

In a further embodiment of the ink-jet recording head, the high temperature section and the low temperature section are provided by making nonuniform the thermal conductivity of the lower layer corresponding to the heat-generating portion.

In a still further embodiment of the ink-jet recording head, the boundary at which the thickness of the protective layer varies is the boundary between the thin region and the thick region of the protective layer.

In a still further embodiment of the ink-jet recording head, the boundary at which the thickness of the protective layer varies is the boundary between the region having the protective layer and the region having no protective layer.

In another aspect of the present invention, there is provided an ink-jet recording apparatus having the above ink-jet recording head and a means for delivering a recording medium.

The present invention enables decrease of the thickness of the protective layer, or omission of the protective layer without impairing the durability of the recording head, whereby energy saving of the entire recording head is achievable, and the temperature rise of the recording head body during printing can be reduced.

Further, the ink-jet recording head of the present invention has high discharge durability, and giving high printing quality and high printing stability owing to the sufficient bubbling stability in the nozzle and the high discharge stability.

Owing to the high discharge stability, a less expensive driving unit is available at a lower driving current intensity and at a uniformed driving voltage, enabling production of ink-jet recording head at a lower cost.

Furthermore, the ink-jet recording apparatus employing the ink-head is applicable to a variety of printing paper because of the high durability of the recording head against various kinds of inks.

DETAILED DESCRIPTION OF THE PREFERRED EMBODIMENTS

The present invention is described below in more detail by reference to the drawings.

Figure 1A:
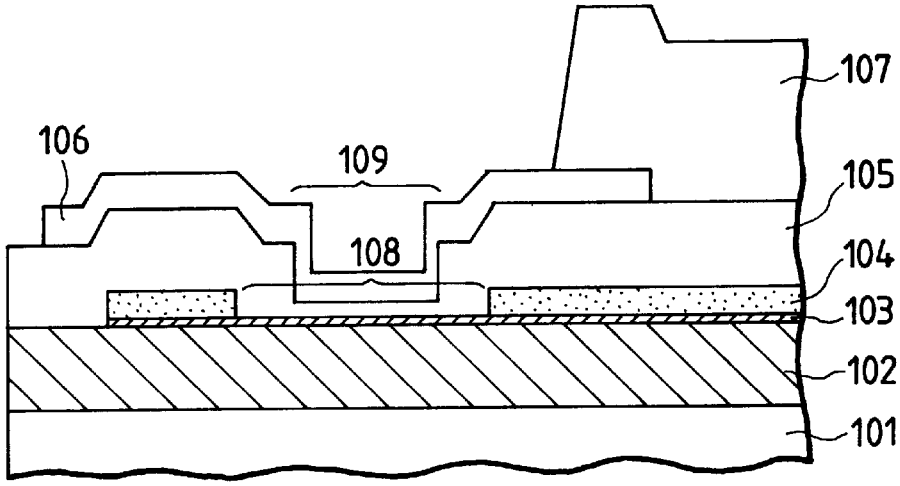
FIGS. 1A and 1B are sectional and plan views for explaining a heater board of a first embodiment of the ink-jet recording head of the present invention, respectively.
Figure 1B:
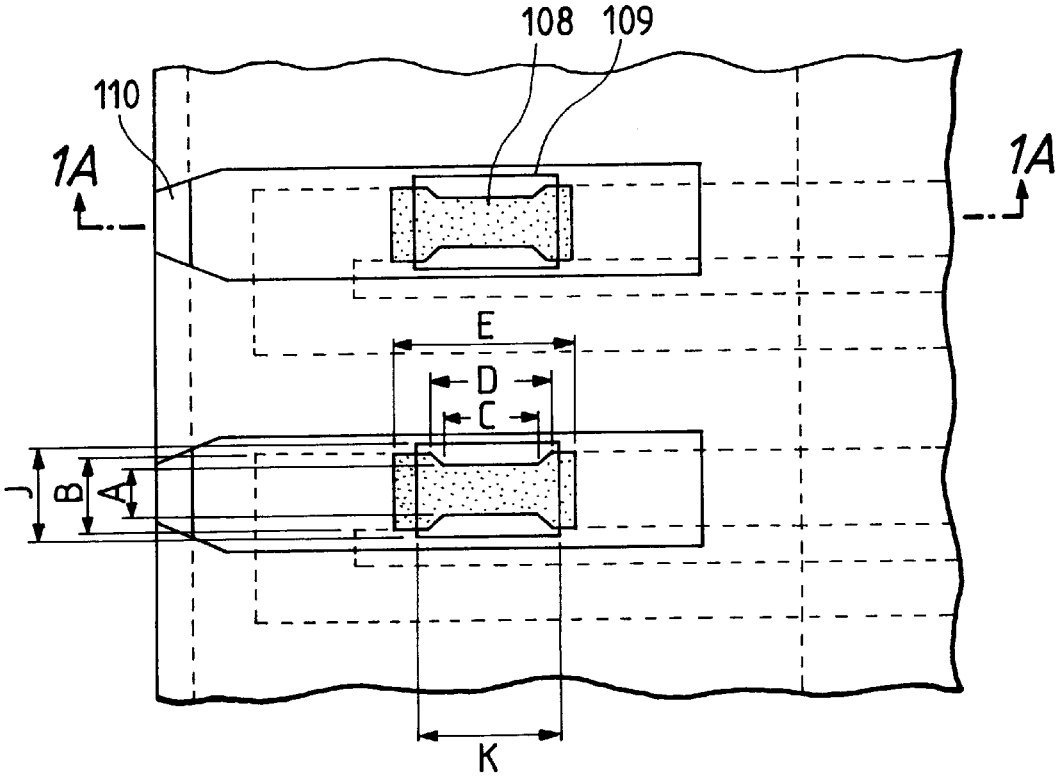

FIGS. 1A and 1B illustrate an example of a heater board of an ink-jet recording head of a first embodiment of the present invention. FIG. 1B is a plan view of the heater board, and FIG. 1A is a sectional view taken along line 1A—1A in FIG. 1B. In FIG. 1A the heater board comprises a substrate 101, a lower layer 102 for heat accumulation, a resistance layer 103, a pair of wiring electrode layers 104 for supplying electricity to the resistance layer, a protective layer 105 for protecting the resistance layer and the wiring electrodes against ink, a second protective layer 106, and a third protective layer 107. The numeral 108 indicates a heat-generating portion of the resistance layer between the pair of the wiring electrodes, and the numeral 109 indicates a thin region of the protective layer 105. In FIG. 1B, the numeral 108 indicates the heat-generating portion, and the numeral 109 indicates the thin region of the protective layer.

The second protective layer is provided to retard cavitation caused on bubble disappearance. The third protective layer (organic protective layer, or the like) is provided to further reduce the short circuit and damage caused by penetration of ink. These protective layers are provided optionally for improvement of the functionality. This is also true for the second and third protective layers in FIGS. 2A, 2B, 3A, 3B, 4A and 4B.

The first embodiment is characterized in that the pattern width of the resistance layer is partly changed to form a high temperature section and a low temperature section of the heat-generating portion when driven, and that the boundary at which the thickness of the protective layer varies is positioned on the low temperature section. In other words, the pattern width of the heat-generating portion 108 of the resistance layer 103 is made broader to reduce the electric current density on and around the pattern border between the heat-generating portion 108 and the wiring electrode layers 104. Thereby, the temperature rise is retarded on and around the pattern border to provide the low temperature section. By positioning the boundary at which the thickness of the protective layer varies on the low temperature section, the thermal stress produced in the protective layer 105 can be reduced on and around the above pattern border.

Excessively large pattern width of the part of the above pattern in the heat-generating portion increases the rate of change of the pattern width to cause concentration of the electric current to the changing portion, leading to breakdown or damage of the heat-generating portion. The ratio (B/A) of change in the pattern width is preferably in the range of from 1.1 to 2.8, more preferably from 1.2 to 2.5.

The width of the resistance layer pattern under the wiring electrode layer is not specially limited, but is preferably larger than the pattern width (A) of the heat-generating portion, and may be the same as the pattern breadth (B) of the heat-generating portion, as shown in FIG. 1B.

Further in the first embodiment, as shown in FIGS. 1A and 1B, a thin region 109 of the protective layer is formed on the region of the heat-generating portion which becomes a high temperature section on driving. This thin protective layer region 109 is formed on the aforementioned heat-generating portion of the resistance layer such that the boundary between the thick and thin regions of the protective layer is placed on the aforementioned broad pattern width zone of the heat-generating portion (low temperature section on driving) in the vicinity of the pattern border between the heat-generating portion and the wiring electrode layer. Since the broad pattern width zone causes less temperature rise on driving, less thermal stress is produced in the boundary between the thin and thick regions of the protective layer on the broad pattern zone of the heat-generating portion, and breakdown or damage of the protective layer or the resistance layer by the thermal stress is less liable to occur.

The thin protective layer region 109 is formed such that any other boundary between the thick and thin regions of the protective layer which is not on or around the aforementioned pattern border is positioned outside the heat-generating portion. This is conducted also in prior arts (FIG. 9B and FIG. 10B).

Figure 5A:
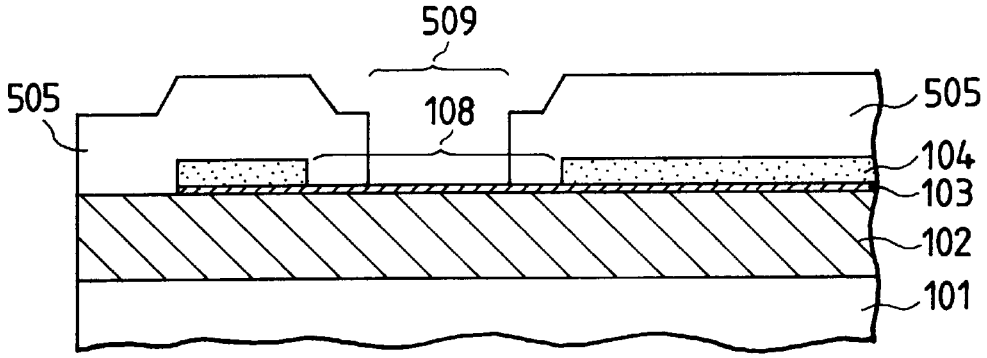
FIGS. 5A and 5B are sectional and plan views for explaining a heater board of a fifth embodiment of the ink-jet recording head of the present invention, respectively.
Figure 5B:
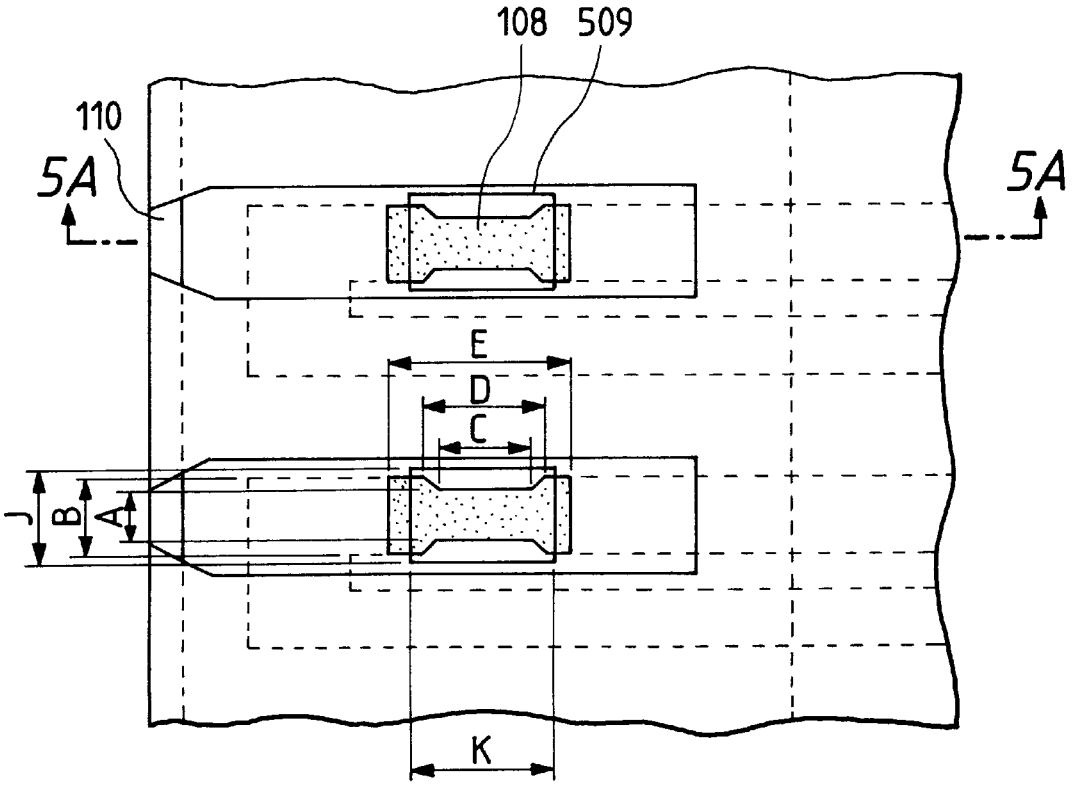

In the first embodiment, in FIGS. 1A and 1B, the boundary at which the thickness of the protective layer varies is the boundary between the thin region and the thick region of the protective layer (feature of the fifth embodiment). The position of the boundary is decided similarly in the same manner as in the case where the boundary at which the thickness of the protective layer varies is the boundary between a region covered with a protective layer 505 and a non-covered region 509 (the sixth embodiment) as shown in FIGS. 5A and 5B. In other words, in the heater board in which the heat-generating portion of the resistance layer is not protected by a protective layer and is brought into direct contact with ink, the boundary between the protective layer-covered region and the non-covered region is positioned on the broad pattern width zone of the heat-generating portion similarly as in the above first embodiment.

Figure 2A:
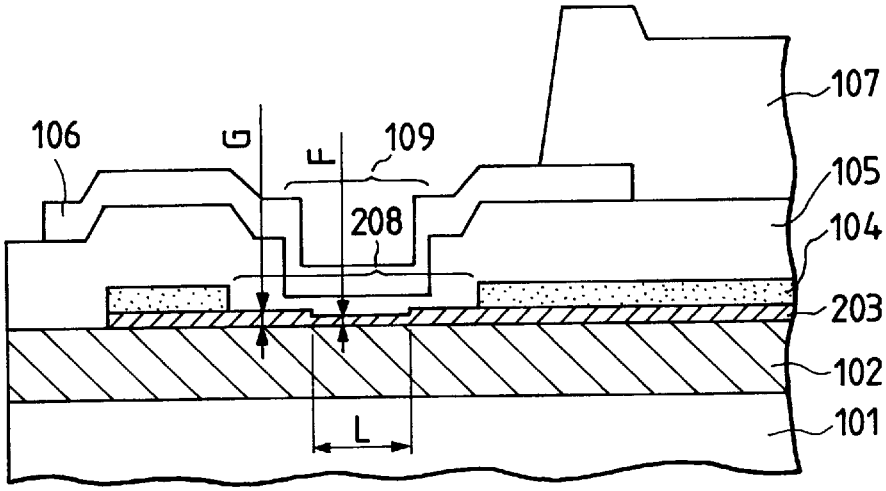
FIGS. 2A and 2B are sectional and plan views for explaining a heater board of a second embodiment of the ink-jet recording head of the present invention, respectively.
Figure 2B:
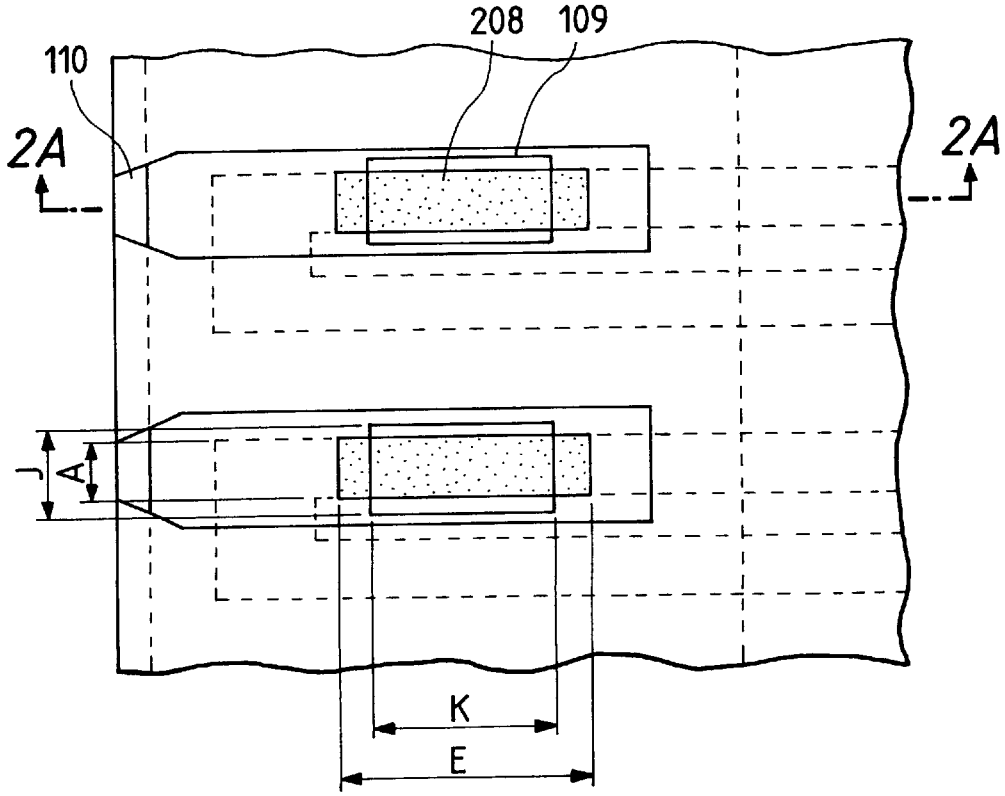

FIGS. 2A and 2B illustrate an example of a heater board of an ink-jet recording head of a second embodiment of the present invention. FIG. 2B is a plan view of the heater board, and FIG. 2A is a sectional view taken along line 2A—2A in FIG. 2B. In FIG. 2A, the heater board comprises a substrate 101, a lower layer 102 for heat accumulation, a resistance layer 203, a pair of wiring electrode layers 104 for supplying electricity to the resistance layer, a protective layer 105 for protecting the resistance layer and the wiring electrodes against ink, a second protective layer 106, and a third protective layer 107. The numeral 208 indicates a heat-generating portion of the resistance layer between the pair of the wiring electrodes, and the numeral 109 indicates a thin region of the protective layer 105. In FIG. 2B, the numeral 208 indicates the heat-generating portion, and the numeral 109 indicates the thin region of the protective layer.

The second embodiment is characterized in that the thickness of the resistance layer is partly changed to form a high temperature section and a low temperature section of the heat-generating portion when driven, and that the boundary at which the thickness of the protective layer varies is positioned on the low temperature section. In other words, the resistance layer 203 of the heat-generating portion 208 is made thicker on and around the pattern border between the heat-generating portion 208 and the wiring electrode layers 104 to reduce the electric current density therein. Thereby, the temperature rise is retarded on and around the pattern border to provide the low temperature section. By positioning the boundary at which the thickness of the protective layer varies on the low temperature section, the thermal stress produced in the protective layer 105 can be reduced on and around the above pattern border.

Excessively large thickness of the part of the resistance layer in the heat-generating portion increases the rate of change in the thickness to cause concentration of the electric current to the changing portion, leading to breakdown or damage of the heat-generating portion. The rate (G/F) of change in the thickness is preferably in the range of from 1.1 to 2.5, more preferably from 1.2 to 2.0.

The thickness of the resistance layer under the wiring electrode layers is not specially limited, but is preferably larger than the thickness (F) at the heat-generating portion, and may be the same as the thickness (G) of the heat-generating portion as shown in FIG. 2A.

Further in the second embodiment, as shown in FIGS. 2A and 2B, a thin region 109 of the protective layer is formed on the region of the heat-generating portion which becomes a high temperature section on driving. This thin protective layer region 109 is formed on the aforementioned heat-generating portion of the resistance layer such that the boundary of the thick and thin regions of the protective layer is positioned on the aforementioned thick zone of the heat-generating portion (low temperature section on driving) in the vicinity of the pattern border between the heat-generating portion and the wiring electrode layer. Since the thick zone of the resistance layer at the heat-generating portion causes less temperature rise on driving, less thermal stress is produced in the boundary between the thin and thick regions of the protective layer on the thick zone of the heat-generating portion, and breakdown or damage of the protective layer or the resistance layer by the thermal stress is less liable to occur.

Further the thin protective layer region 109 is formed such that any other boundary between the thick and thin regions of the protective layer which is not on or around the aforementioned pattern border is positioned outside the heat-generating portion. This is conducted also in prior arts (FIG. 9B and FIG. 10B).

Figure 6A:
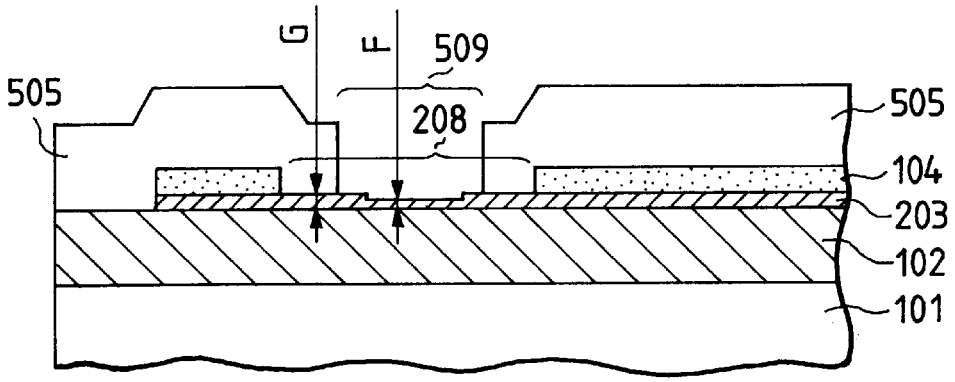
FIGS. 6A and 6B are sectional and plan views for explaining a heater board of a sixth embodiment of the ink-jet recording head of the present invention, respectively.
Figure 6B:
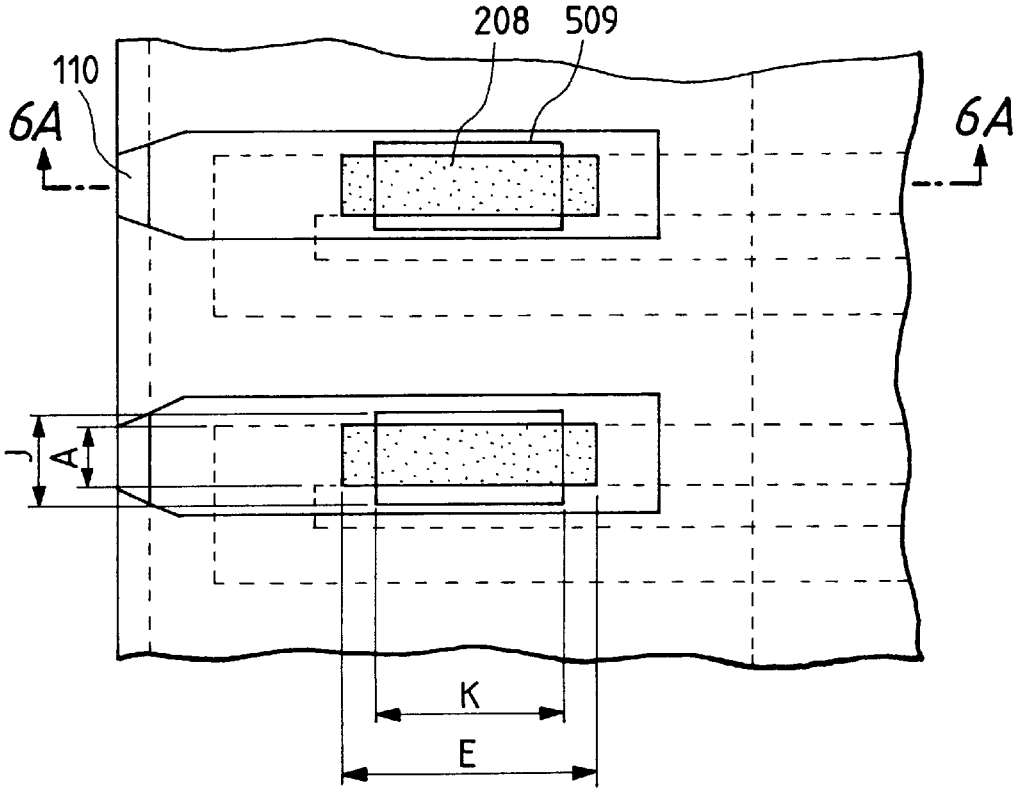

In the second embodiment, in FIGS. 2A and 2B, the boundary at which the thickness of the protective layer varies is the boundary between the thin region and the thick region of the protective layer (feature of the fifth embodiment). The position of the boundary is decided similarly when the boundary at which the thickness of the protective layer varies is the boundary between a region covered with a protective layer 505 and a non-covered region 509 (the sixth embodiment) as shown in FIGS. 6A and 6B. In other words, in the heater board in which the heat-generating portion of the resistance layer is not protected by a protective layer and is brought into direct contact with ink, the boundary between the protective layer-covered region and the non-covered region is positioned on the thick layer zone of the resistance layer on the heat-generating portion similarly as in the above second embodiment.

Figure 3A:
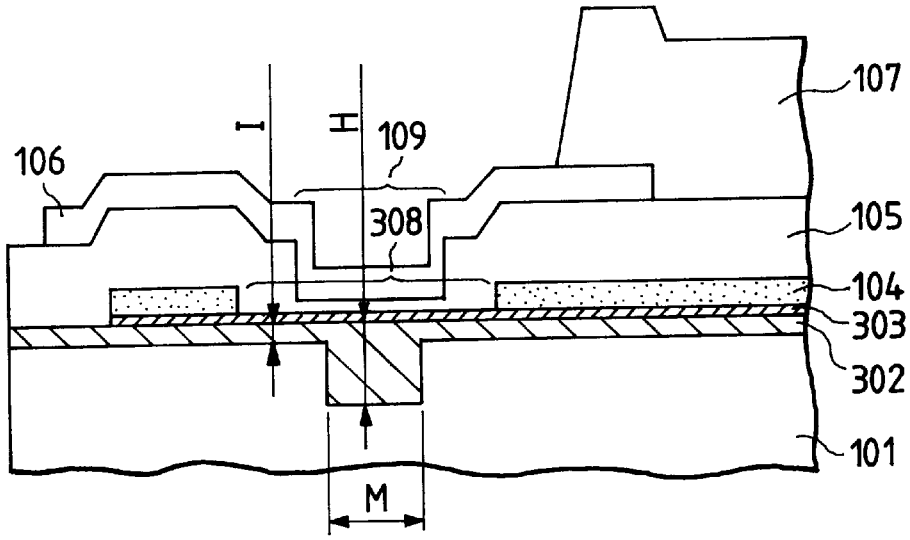
FIGS. 3A and 3B are sectional and plan views for explaining a heater board of a third embodiment of the ink-jet recording head of the present invention, respectively.
Figure 3B:
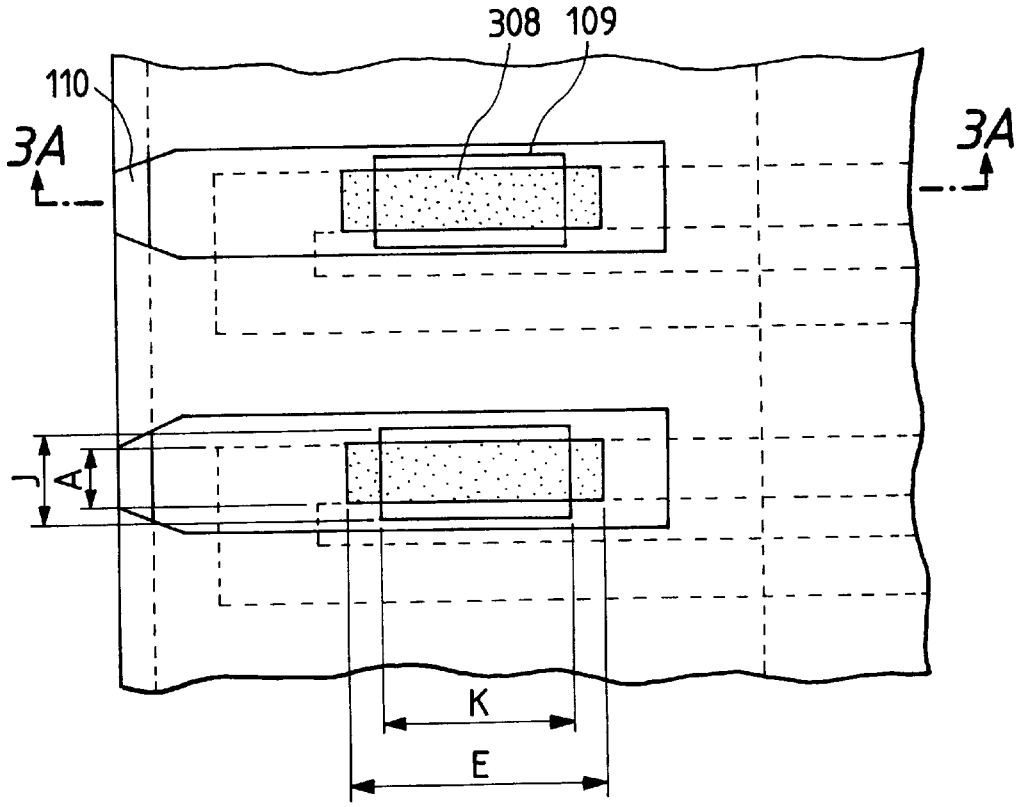

FIGS. 3A and 3B illustrate an example of a heater board of an ink-jet recording head of a third embodiment of the present invention. FIG. 3B is a plan view of the heater board, and FIG. 3A is a sectional view taken along line 3A—3A in FIG. 3B. In FIG. 3A, the heater board comprises a substrate 101, a lower layer 302 for heat accumulation, a resistance layer 303, a pair of wiring electrode layers 104 for supplying electricity to the resistance layer, a protective layer 105 for protecting the resistance layer and the wiring electrodes against ink, a second protective layer 106, and a third protective layer 107. The numeral 308 indicates a heat-generating portion of the resistance layer between the pair of the wiring electrodes, and the numeral 109 indicates a thin region of the protective layer 105. In FIG. 3B, the numeral 308 indicates the heat-generating portion, and the numeral 109 indicates the thin region of the protective layer.

The third embodiment is characterized in that the thickness of the lower layer is partly changed to form a high temperature section and a low temperature section of the heat-generating portion when driven, and that the boundary at which the thickness of the protective layer varies is positioned on the low temperature section. In other words, the lower layer 302 is partly made thinner underneath the heat-generating portion at and around the pattern border between the heat-generating portion 308 and the wiring electrode layer 104 as compared with the other region underneath the heat-generating portion. Thereby, the temperature rise is retarded on and around the pattern border to provide the low temperature section. By positioning the boundary at which the thickness of the protective layer varies on the low temperature section, the thermal stress produced in the protective layer 105 can be reduced on and around the above pattern border.

Extreme thinness of the part of the aforementioned underlayer increases the rate of change in the thickness to increase the temperature difference at that changing portion, leading to breakdown or damage of the heat-generating portion. The rate (I/H) of change in the thickness is preferably in the range of from 0.1 to 0.9, more preferably from 0.2 to 0.8.

The thickness of the lower layer underneath the wiring electrode layers is not specially limited, but is preferably less than the thickness (H) of the lower layer in the heat-generating portion, and may be the same as the thickness (I) of the lower layer in the heat-generating portion as shown in FIG. 3A.

Further in the third embodiment, as shown in FIGS. 3A and 3B, a thin region 109 of the protective layer is formed on the region of the heat-generating portion which becomes a high temperature region on driving. This thin protective layer region 109 is formed above the aforementioned underlayer such that the boundary of the thick and thin regions of the protective layer is positioned on the aforementioned thin zone of underlayer in the heat-generating portion (low temperature section on driving) in the vicinity of the pattern border between the heat-generating portion and the wiring electrode layer. Since the resistance layer on the thin underlayer zone less temperature rise on driving, less thermal stress is produced in the boundary between the thin and thick regions of the protective layer in this layer zone, and breakdown or damage of the protective layer or the resistance layer by the thermal stress is less liable to occur.

Further the thin protective layer region 109 is formed such that any other boundary between the thick and thin regions of the protective layer which is not on or around the aforementioned pattern border is positioned outside the heat-generating portion. This is conducted also in prior arts (FIG. 9B and FIG. 10B).

Figure 7A:
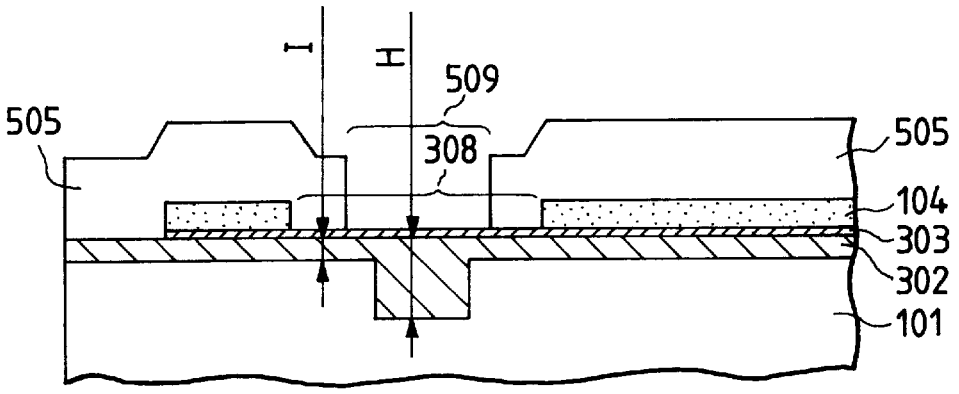
FIGS. 7A and 7B are sectional and plan views for explaining a heater board of a seventh embodiment of the ink-jet recording head of the present invention, respectively.
Figure 7B:
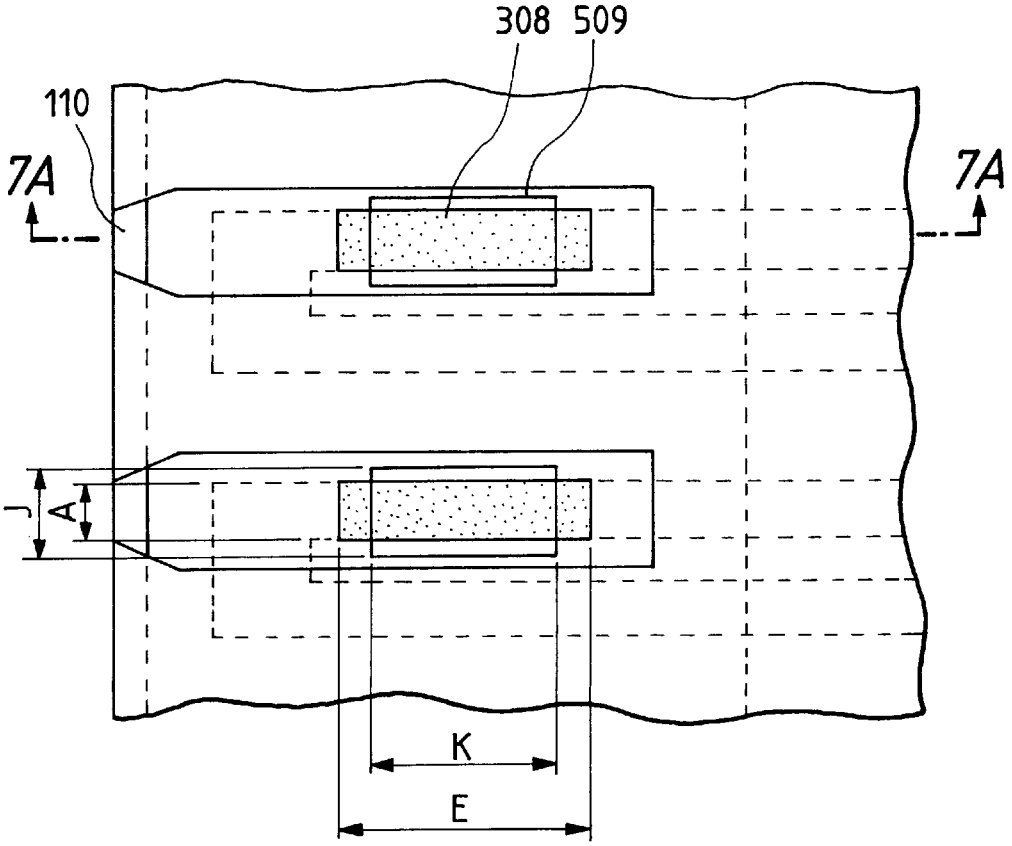

In the third embodiment, in FIGS. 3A and 3B, the boundary at which the thickness of the protective layer varies is the boundary between the thin and thick regions of the protective layer (feature of the fifth embodiment). The position of the boundary is decided similarly when the boundary at which the thickness of the protective layer varies is the boundary between a region covered with a protective layer 505 and a non-covered region 509 (the sixth embodiment) as shown in FIGS. 7A and 7B. In other words, in the heater board in which the heat-generating portion of the resistance layer is not protected by a protective layer and is brought into direct contact with ink, the boundary between the protective layer-covered region and the non-covered region is positioned on the thin layer zone of the lower layer in the heat-generating portion similarly as in the above third embodiment.

Figure 4A:
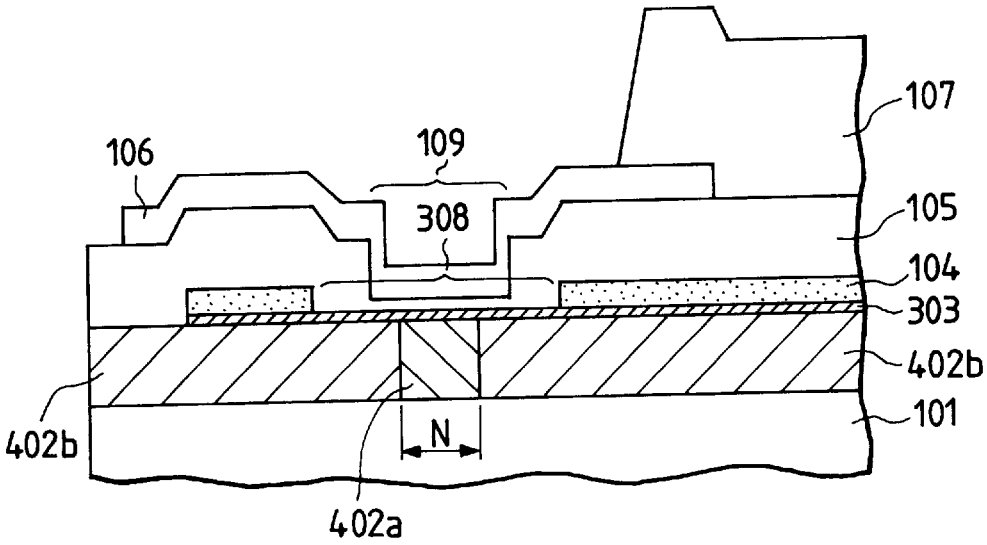
FIGS. 4A and 4B are sectional and plan views for explaining a heater board of a fourth embodiment of the ink-jet recording head of the present invention, respectively.
Figure 4B:
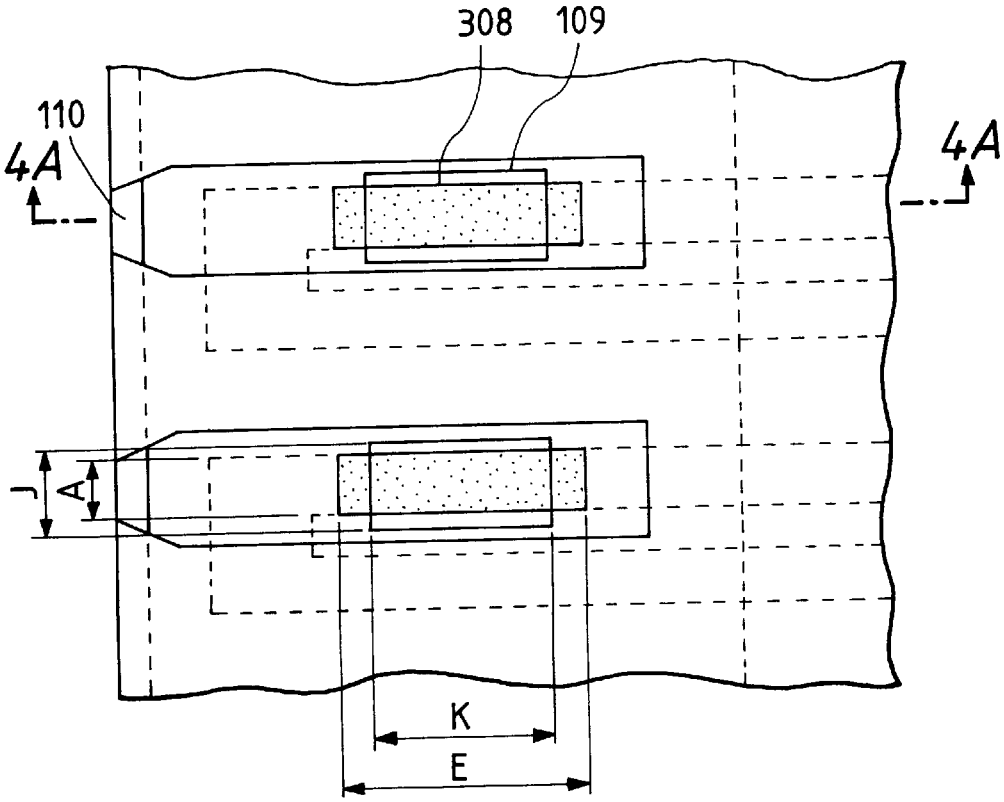

FIGS. 4A and 4B illustrate an example of a heater board of an ink-jet recording head of a fourth embodiment of the present invention. FIG. 4B is a plan view of the heater board, and FIG. 4A is a sectional view taken along line 4A—4A in FIG. 4B. In FIG. 4A, the heater board comprises a substrate 101, a lower layer 402*a* constituted of a material of low thermal conductivity, a lower layer 402*b* constituted of a material of high thermal conductivity, a resistance layer 303, a pair of wiring electrode layers 104 for supplying electricity to the resistance layer, a protective layer 105 for protecting the resistance layer and the wiring electrodes against ink, a second protective layer 106, and a third protective layer 107. The numeral 308 indicates a heat-generating portion of the resistance layer between the pair of the wiring electrodes, and the numeral 109 indicates a thin region of the protective layer 105. In FIG. 4B, the numeral 308 indicates the heat-generating portion, and the numeral 109 indicates the thin region of the protective layer.

The fourth embodiment is characterized in that the material of the lower layer is changed locally to constitute a high temperature section and a low temperature section of the heat-generating portion when driven, and that the boundary at which the thickness of the protective layer is positioned on the low temperature section. In other words, the lower layer is locally made from a material having thermal conductivity higher in the region underneath the heat-generating portion at and around the pattern border between the heat-generating portion 308 and the wiring electrode layer 104 than in other region of the lower layer. Thereby, the temperature rise is retarded on and around the pattern border between the heat-generating portion and the wiring electrode layer to provide the low temperature section. By positioning the boundary at which the thickness of the protective layer varies on the low temperature section, the thermal stress produced in the protective layer 105 can be reduced on and around the above pattern border.

The region 402*b* of the lower layer underneath the region of the heat-generating portion at or around the pattern border between the heat-generating portion and the wiring electrodes (namely the low temperature region on driving) is made of a material of higher thermal conductivity than the region 402*a* of the lower layer underneath the heat-generating portion (namely the high temperature region on driving). For example, in the case where the region 402*a* of the lower layer underneath the high temperature region is composed of $SiO_2$, the region 402*b* of the lower layer underneath the low temperature region is made from $Si_3N_4$, $Al_2O_3$, or the like having thermal conductivity higher than $SiO_2$.

The material of the lower layer underneath the wiring electrode layers is not specially limited, but is preferably a material having thermal conductivity higher than the region 402*a* of the lower layer underneath the heat-generating portion (the high temperature region on driving), and may be the same material as that of the region 402*b* underneath the heat-generating portion (the low-temperature region on driving), as shown in FIG. 4A.

Further in the fourth embodiment, as shown in FIGS. 4A and 4B, a thin region 109 of the protective layer is formed on the region of the heat-generating portion which becomes a high temperature region on driving. This thin protective layer region 109 is formed above the aforementioned heat-generating portion of the lower layer such that the boundary between the thick and the thin regions of the protective layer is positioned above the aforementioned high thermal conductivity zone of underlayer in the heat-generating portion (low temperature region on driving) in the vicinity of the pattern border between the heat-generating portion and the wiring electrode layer. Since the resistance layer on the lower layer region composed of higher thermal conductivity material causes less temperature rise on driving, less thermal stress is produced in the thickness change boundary of the protective layer on this zone, and breakdown or damage of the protective layer or the resistance layer by the thermal stress is less liable to occur.

Further the thin protective layer region 109 is formed such that any other boundary between the thick and thin regions of the protective layer which is not on or around the aforementioned pattern border is positioned outside the heat-generating portion. This is conducted also in prior arts (FIG. 9B and FIG. 10B).

Figure 8A:
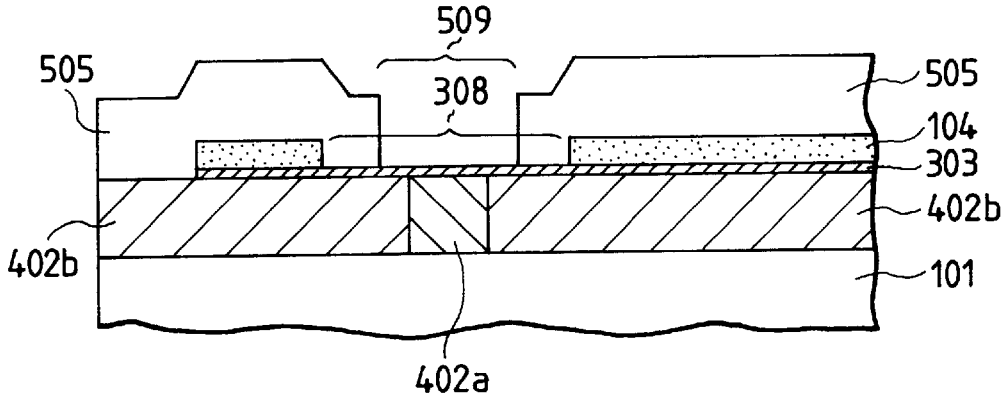
FIGS. 8A and 8B are sectional and plan views for explaining a heater board of a eighth embodiment of the ink-jet recording head of the present invention, respectively.
Figure 8B:
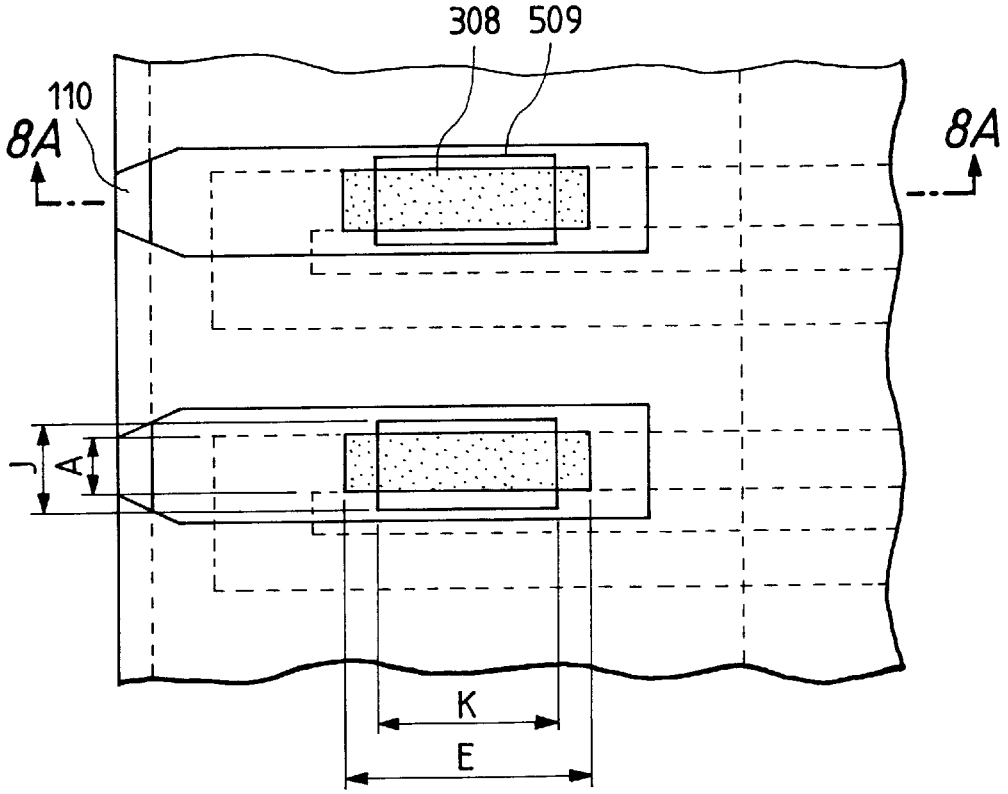

In the fourth embodiment, in FIGS. 4A and 4B, the boundary at which the thickness of the protective layer varies is the boundary between the thin and thick regions of the protective layer (feature of the fifth embodiment). The position of the boundary is decided similarly when the boundary at which the thickness of the protective layer varies is the boundary between a region covered with a protective layer 505 and a non-covered region 509 (the sixth embodiment) as shown in FIGS. 8A and 8B. In other words, in the heater board in which the heat-generating portion of the resistance layer is not protected by a protective layer and is brought into direct contact with ink, the boundary between the protective layer-covered region and the non-covered region is positioned on the high thermal conductivity region of the lower layer in the heat-generating portion similarly as in the above fourth embodiment.

Figure 11:
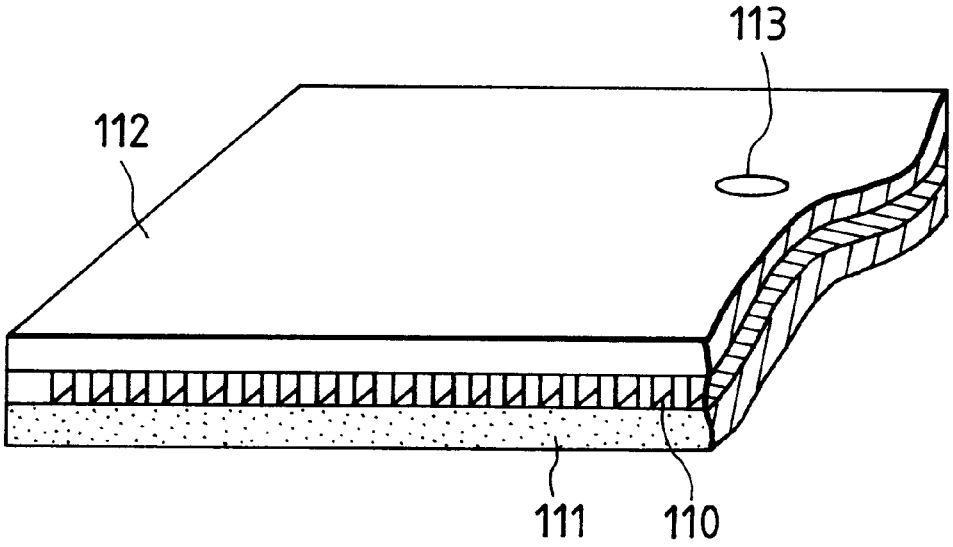
FIG. 11 is a perspective view of an ink-jet recording head of the present invention.

The ink-jet recording head having the heater board of the present invention can be employed as a full-line type recording head which has plural discharge openings over the full width of the recording region of a recording medium as shown in FIG. 11. The recording head in FIG. 11 comprises discharge openings 110, a heater board 111, a ceiling plate 112, and an ink supplying opening 113.

The present invention is especially effective for the ink-jet recording head or the ink-jet recording apparatus which conducts recording by allowing liquid droplets to fly by utilizing thermal energy.

A typical constitution and the principle of such recording head and ink-jet recording apparatus are disclosed, for example, in U.S. Pat. Nos. 4,723,129, and 4,740,796.

The ink-jet recording systems based on this principle is applicable to any of on-demand type and continuous type ink-jet recording, especially effective for on-demand type ones. With the on-demand type system, the recording is conducted as follows. One or more driving signals are applied to an electrothermal transducer provided on a sheet or a liquid path holding a liquid (ink) in correspondence with recording information for causing abrupt rise of liquid temperature exceeding nuclear boiling point to generate thermal energy in the electrothermal transducer, thereby causing film boiling on the heat actuating surface of the recording head to form bubbles in the liquid (ink) in one-to-one correspondence with the driving signal. The ink is discharged through the ink discharge opening by growth and shrinkage of the bubbles, and is allowed to fly in a form of liquid droplets.

Pulse-shaped driving signals enables instantaneous and suitable growth and shrinkage of the bubbles to achieve ink ejection with excellent responsiveness. Suitable driving signals are described in U.S. Pat. Nos. 4,463,359 and 4,345,262. The recording can be more excellently conducted by employing the conditions disclosed in U.S. Pat. No. 4,313,124 regarding the temperature rise rate of the heat actuating surface.

The ink-jet recording head of the present invention may be constituted of combination of a liquid droplet discharge opening, a liquid path, and an electrothermal transducer (linear liquid path construction or rectangular liquid path construction) as described in the above patent specifications, or may be in construction in which a heat actuating surface is arranged in a bending region as disclosed in U.S. Pat. Nos. 4,558,333 and 4,459,600.

Further, the present invention is effective also in the constitution comprising a common slit for plural electrothermal transducers as a discharge portion (disclosed in Japanese Patent Application Laid-Open No. 59-123670), and the constitution comprising an opening corresponding to the discharge portion to absorb pressure waves of the thermal energy (disclosed in Japanese Patent Application Laid-Open No. 59-138461.

The present invention is also effective for full-line type ink-jet recording head which has a length corresponding to the maximum recording width of the recording apparatus. The full-line type recording head may be either a combination of plural recording heads or an integrated construction as disclosed in the aforementioned patent specifications.

The ink-jet recording head may be an exchangeable tip type recording head which can be connected electrically to the main body of the ink-jet recording apparatus or can be fed with ink from the main body thereof, or may be a cartridge type recording head integrally provided with an ink tank.

As the construction unit of the ink-jet recording apparatus in the present invention, a recovery means for the recording head or a preliminary supplemental means are preferably employed for achieving more stable effect of the present invention. Specifically the means include a capping means for the recording head, a cleaning means, pressurizing and sucking means, preliminary heating means, and preliminary discharge means.

The recording mode of the ink-jet recording apparatus of the present invention may be a black or other mono-color mode, a multi-color mode employing different colors, or a full-color mode employing color mixing.

The present invention is most effective for film-boiling system for the aforementioned inks.

The ink-jet recording apparatus of the present invention includes integrated or separated terminal for image output of information processing apparatus such as word processors and computers, and copying apparatuses combined with a reader, and facsimile apparatuses having transmission and reception functions.

The present invention is described in more detail by reference to examples without limiting the invention in any way.

EXAMPLES 1 TO 7

An ink-jet recording head was prepared which had the constitution shown in FIGS. 1A and 1B.

On a silicon substrate as the substrate 101, an $SiO_2$ layer of 2.0 μm thick was formed as the heat-accumulating underlayer 102 by thermal oxidation. Thereon, an $HfB_2$ layer of 0.1 μm thick was formed as the resistance layer 103 by sputtering. This layer had a sheet resistance of 20 Ω/□. Further thereon, a Ti layer of 0.005 μm thick, and an Al layer of 0.6 μm thick were formed as the wiring electrode layer 104 by vapor deposition.

Then a circuit pattern for the heat-generation portion 108 and the wiring electrode layer 104 was formed by photolithography and etching as shown in FIGS. 1A and 1B. The dimensions of C, D, and E in FIG. 1B were 100 μm, 120 μm, and 140 μm, respectively, and the dimensions A and B are shown in Table 1.

An $SiO_2$ layer of 1.0 μm thick was formed thereon as the protective layer 105 by sputtering. Then the thin region 109 of 0.2 μm thick of the protective layer was formed by partially removing a 0.8 μm-thick portion of the $SiO_2$ layer by photolithographic patterning and dry-etching as shown in FIGS. 1A and 1B. The thin region of the protective layer 105 had a dimension J of 40 μm, and a dimension K of 130 μm. The boundaries of the thick region and the thin region of the protective layer 105 near the pattern borders between the heat-generating portion 108 and the wiring electrode layer 104 were positioned on the zone of broad pattern width (width B) of the heat-generating portion.

Then, the second protective layer 106 was formed from Ta by sputtering, and subsequent photolithography and dry etching in a pattern as shown in FIG. 1A. Finally the third protective layer 107 of 2.0 μm thick was formed by coating application of a photosensitive polyimide and subsequent pattering by photolithography.

The heater board prepared above was employed for production of an ink-jet recording head shown in FIG. 11. On the heater board 111, nozzle walls were formed from a negative DF (Dry Film) by photolithography. Thereon a glass ceiling plate 112 having an ink-supplying opening 113 was bonded to cover the nozzle walls. Finally, the resulting combination constituted of the heater board, the nozzle walls, and the ceiling plate was cut in a prescribed shape simultaneously to form discharge openings 110. Thus the ink-jet recording head of the present invention was produced.

EXAMPLES 8 TO 13

An ink-jet recording head was prepared which had the constitution shown in FIGS. 2A and 2B.

On a silicon substrate as the substrate 101, an $SiO_2$ layer of 2.0 μm thick was formed as the heat-accumulating underlayer 102 by thermal oxidation. Thereon, an $HfB_2$ layer was formed as the resistance layer 203 by sputtering in a thickness G as shown in Table 2. Further thereon, a Ti layer of 0.005 μm thick, and an Al layer of 0.6 μm thick were formed as the wiring electrode layer 104 by vapor deposition.

Then the circuit pattern for the heat-generation portion 208 and the wiring electrode layer 104 was formed by photolithography and etching as shown in FIGS. 2A and 2B. A part of the heat-generating portion 208 was thinned to a desired thickness by photolithographic patterning and dry etching as shown in FIG. 2A. The thickness (F) of the thin zone is shown in Table 2. The dimension of the thin zone of the heat-generating portion was 20 μm×100 μm. This dimension of 100 μm corresponds to the dimension L in FIG. 2A.

An $SiO_2$ layer of 1.0 μm thick was formed thereon as the protective layer 105 by sputtering. Then the thin region 109 of 0.2 μm thick of the protective layer was formed by partially removing the 0.8 μm thick portion of the $SiO_2$ layer by photolithographic patterning and dry-etching as shown in FIGS. 2A and 2B. The thin region of the protective layer had a dimension J of 40 μm, and a dimension K of 130 μm similarly as in Examples 1 to 7. The boundaries of the thick region and the thin region of the protective layer 105 near the pattern border between the heat-generating portion 108 and the wiring electrode layer 104 was positioned on the thick zone (thickness G) of the heat-generating portion 208.

Then, the second protective layer 106 was formed from Ta by sputtering, and subsequent photolithography and dry etching in a pattern as shown in FIG. 2A. Finally the third protective layer 107 of 2.0 μm thick was formed by coating application of a photosensitive polyimide and subsequent pattering by photolithography.

The heater board prepared above was employed for production of an ink-jet recording head shown in FIG. 11. On the heater board 111, nozzle walls were formed from a negative DF by photolithography. Thereon a glass ceiling plate 112 having an ink-supplying opening 113 was bonded to cover the nozzle walls. Finally, the resulting combination of the heater board, the nozzle walls, and the ceiling plate was cut in a prescribed shape simultaneously to form discharge openings 110. Thus the ink-jet recording head of the present invention was produced.

EXAMPLES 14 TO 17

An ink-jet recording head was prepared which had the constitution shown in FIGS. 3A and 3B.

On a silicon substrate as the substrate, an $SiO_2$ layer was formed as the heat-accumulating underlayer 302 by thermal oxidation. This thermal oxidation was conducted in two steps. In the first thermal oxidation step, the thermal oxidation was conducted to form an $SiO_2$ layer of thickness I. In the following step, an $Si_3N_4$ film was formed by CVD, a portion of the $Si_3N_4$ film was removed from the area where the thickness of the $SiO_2$ underlayer is to be made larger (thickness H), leaving the $Si_3N_4$ film on the area for the thin underlayer part (thickness I). The area having the $Si_3N_4$ film removed had a dimension of 30 μm×100 μm. This dimension of 100 μm corresponds to the dimension M in FIG. 3A. In the second thermal oxidation step, on the $Si_3N_4$-removed area, $SiO_2$ layer was further formed in a total thickness of H. After the thermal oxidation, the $Si_3N_4$ film was removed by etching. In such a manner a lower layer 302 having a locally different thickness was formed on the substrate. The layer thicknesses H and I are shown in Table 3.

Thereon, an $HfB_2$ layer of 0.1 μm thick was formed as the resistance layer 303 by sputtering.

Thereon, a Ti layer of 0.005 μm thick, and an Al layer of 0.6 μm thick were formed as the wiring electrode layer 104 by vapor deposition. Then the circuit pattern for the heat-generation portion 308 and the wiring electrode layer 104 was formed by photolithography and etching as shown in FIGS. 3A and 3B.

An $SiO_2$ layer of 1.0 μm thick was formed thereon as the protective layer 105 by sputtering. Then the thin region 109 of 0.2 μm thick of the protective layer was formed by partially removing a 0.8 μm-thick portion of the $SiO_2$ layer by photolithographic patterning and dry-etching as shown in FIGS. 3A and 3B. The thin region of the protective layer had a dimension J of 40 μm, and a dimension K of 130 μm similarly as in Examples 1 to 7. The boundaries of the thick region and the thin region of the protective layer 105 near the pattern borders between the heat-generating portion 308 and the wiring electrode layer 104 were positioned on the thin zone (thickness I) of the lower layer 302.

Then, the second protective layer 106 was formed from Ta by sputtering, and subsequent photolithography and dry etching in a pattern as shown in FIG. 3A. Finally the third protective layer 107 of 2.0 μm thick was formed by coating application of a photosensitive polyimide and subsequent pattering by photolithography.

The heater board prepared above was employed for production of an ink-jet recording head shown in FIG. 11. On the heater board 111, nozzle walls were formed from a negative DF by photolithography. Thereon a glass ceiling plate 112 having an ink-supplying opening 113 was bonded to cover the nozzle walls. Finally, the resulting combination constituted of the heater board, the nozzle walls, and the ceiling plate was cut in a prescribed shape simultaneously to form discharge openings 110. Thus the ink-jet recording head of the present invention was produced.

EXAMPLE 18

An ink-jet recording head was prepared which had the constitution shown in FIGS. 4A and 4B.

On an entire face of the silicon substrate as the substrate, an $Si_3N_4$ layer was formed in a thickness of 2.0 μm as the lower layer. Then the $Si_3N_4$ in the zone 402*a* of the lower layer where the thermal conductivity is to be lowered was removed by photolithography and etching in a zone dimension of 30 μm×100 μm. This dimension of 100 μm corresponds to the dimension N in FIG. 4A. On the area other than the etched zone, photoresist pattern was formed. Then an $SiO_2$ layer 402*a* of 2.0 μm thick was formed by sputtering. Thereafter the photoresist was removed.

Thereon, an $HfB_2$ layer of 0.1 μm thick was formed as the resistance layer 303 by sputtering. Thereon, a Ti layer of 0.005 μm thick, and an Al layer of 0.6 μm thick were formed as the wiring electrode layer 104 by vapor deposition. Then the circuit pattern for the heat-generation portion 308 and the wiring electrode layer 104 was formed by photolithography and etching as shown in FIGS. 4A and 4B.

An $SiO_2$ layer of 1.0 μm thick was formed thereon as the protective layer 105 by sputtering. Then the thin region 109 of 0.2 μm thick of the protective layer was formed by partially removing a 0.8 μm-thick portion of the $SiO_2$ layer by photolithographic patterning and dry-etching as shown in FIGS. 4A and 4B. The thin region of the protective layer had a dimension J of 40 μm, and a dimension K of 130 μm similarly as in Examples 1 to 7. The boundaries of the thick region and the thin region of the protective layer near the pattern borders between the heat-generating portion 308 and the wiring electrode layer 104 were positioned on the portion of the resistance layer on the zone 402*b* of the lower layer made from a high thermal conductivity material.

Then, the second protective layer 106 was formed from Ta by sputtering, and subsequent photolithography and dry etching in a pattern as shown in FIG. 4A. Finally the third protective layer 107 of 2.0 μm thick was formed by coating application of a photosensitive polyimide and subsequent by photolithographic patterning.

The heater board prepared above was employed for production of an ink-jet recording head shown in FIG. 11. On the heater board 111, nozzle walls were formed from a negative DF by photolithography. Thereon a glass ceiling plate 112 having an ink-supplying opening 113 was bonded to cover the nozzle walls.

Finally, the resulting combination constituted of the heater board, the nozzle walls, and the ceiling plate was cut in a prescribed shape simultaneously to form discharge openings 110. Thus the ink-jet recording head of the present invention was produced.

EXAMPLE 19

An ink-jet recording head was produced in the same manner as in Example 18 except that $Al_2O_3$ was used in place of $Si_3N_4$.

EXAMPLES 20 TO 26

An ink-jet recording head was prepared which had the constitution shown in FIGS. 5A and 5B.

On a silicon substrate as the substrate 101, an $SiO_2$ layer of 2.0 μm thick was formed as the heat-accumulating underlayer 102 by thermal oxidation. Thereon, a Ta-Ir layer of 0.1 μm thick was formed as the resistance layer 103 by sputtering. This layer had a sheet resistance of 15 Ω/□. Further thereon, a Ti layer of 0.005 μm thick, and an Al layer of 0.6 μm thick were formed as the wiring electrode layer 104 by vapor deposition.

Then a circuit pattern for the heat-generation portion 108 and the wiring electrode layer 104 was formed by photolithography and etching as shown in FIGS. 5A and 5B. The dimensions of C, D, and E in FIG. 5B were 100 μm, 120 μm, and 140 μm, respectively, and the dimensions A and B are shown in Table 5.

A photosensitive polyimide layer of 2.0 μm thick was formed thereon as the protective layer 505 by application. Then a portion of the protective layer 505 was removed by photolithographic patterning to give a non-protected region 509. The non-protected region had a dimension J of 40 μm, and a dimension K of 130 μm. The boundaries of the region protected by the protective layer 505 and the non-protected region near the borders between the heat-generating portion 108 and the wiring electrode layer 104 were positioned on the broad pattern width zone (width B) of the heat-generating portion.

The heater board prepared above was employed for production of an ink-jet recording head shown in FIG. 11. On the heater board 111, nozzle walls were formed from a negative DF by photolithography. Thereon a glass ceiling plate 112 having an ink-supplying opening 113 was bonded to cover the nozzle walls. Finally, the resulting combination constituted of the heater board, the nozzle walls, and the ceiling plate was cut in a prescribed shape simultaneously to form discharge openings 110. Thus the ink-jet recording head of the present invention was produced.

Comparative Example 1

Figure 9A:
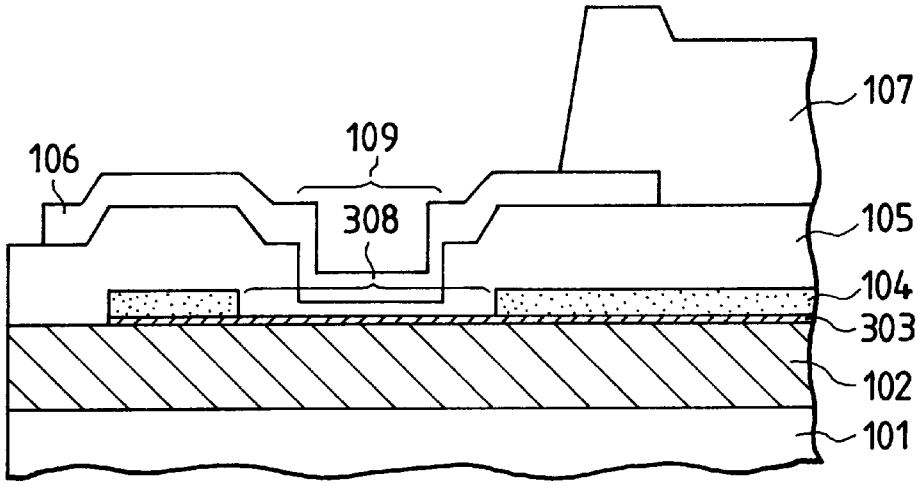
FIGS. 9A and 9B are sectional and plan views for explaining a heater board of a conventional ink-jet recording head, respectively.
Figure 9B:
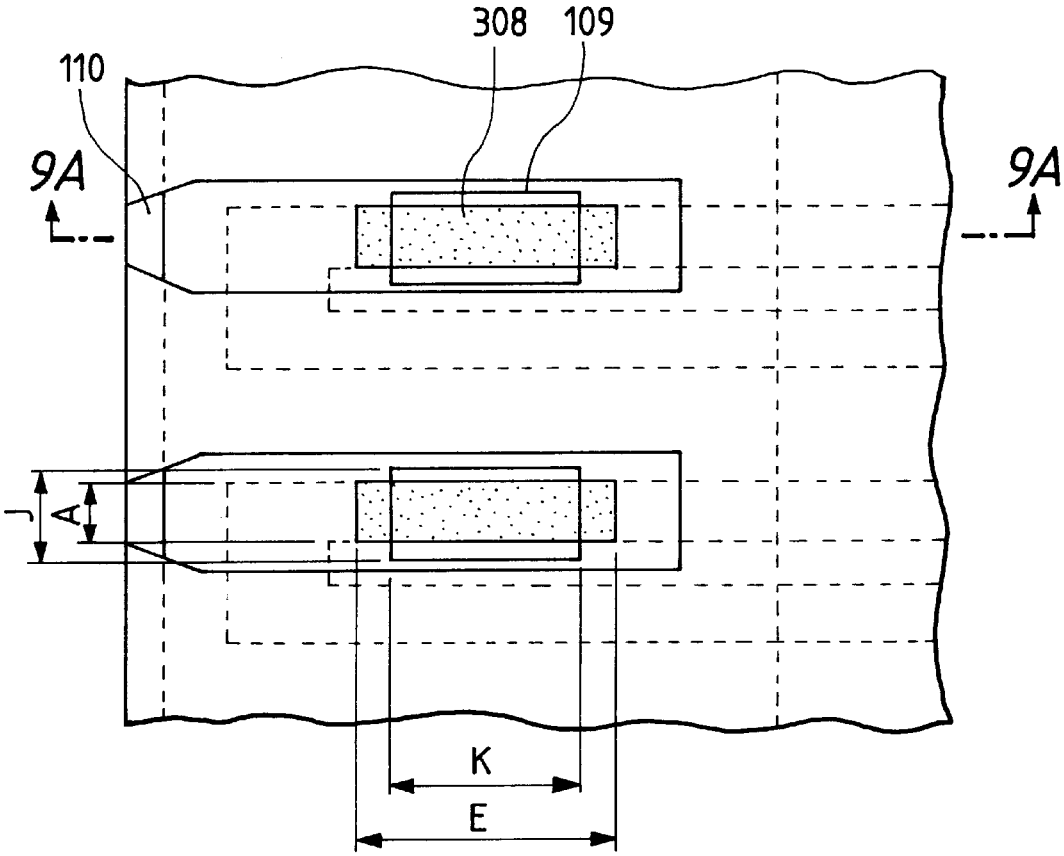

An ink-jet recording head having a constitution shown in FIGS. 9A and 9B was produced in the same manner as in Examples 1 to 7 except that the heat-generating portion was made in a shape as shown in FIGS. 9A and 9B with the dimension A of 20 μm.

Comparative Example 2

Figure 10A:
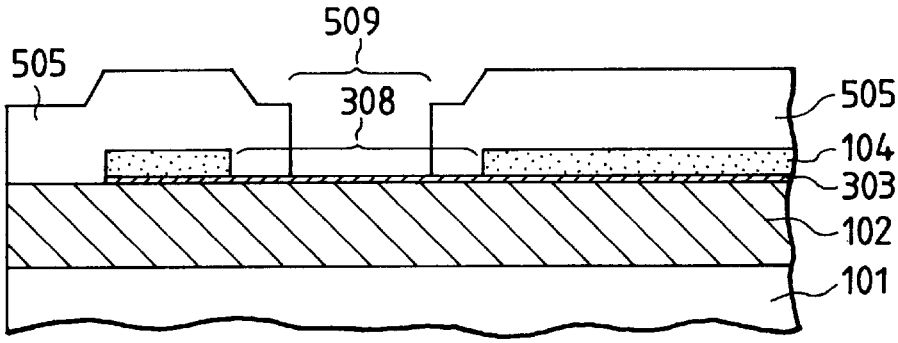
FIGS. 10A and 10B are sectional and plan views for explaining a heater board of a conventional ink-jet recording head, respectively.
Figure 10B:
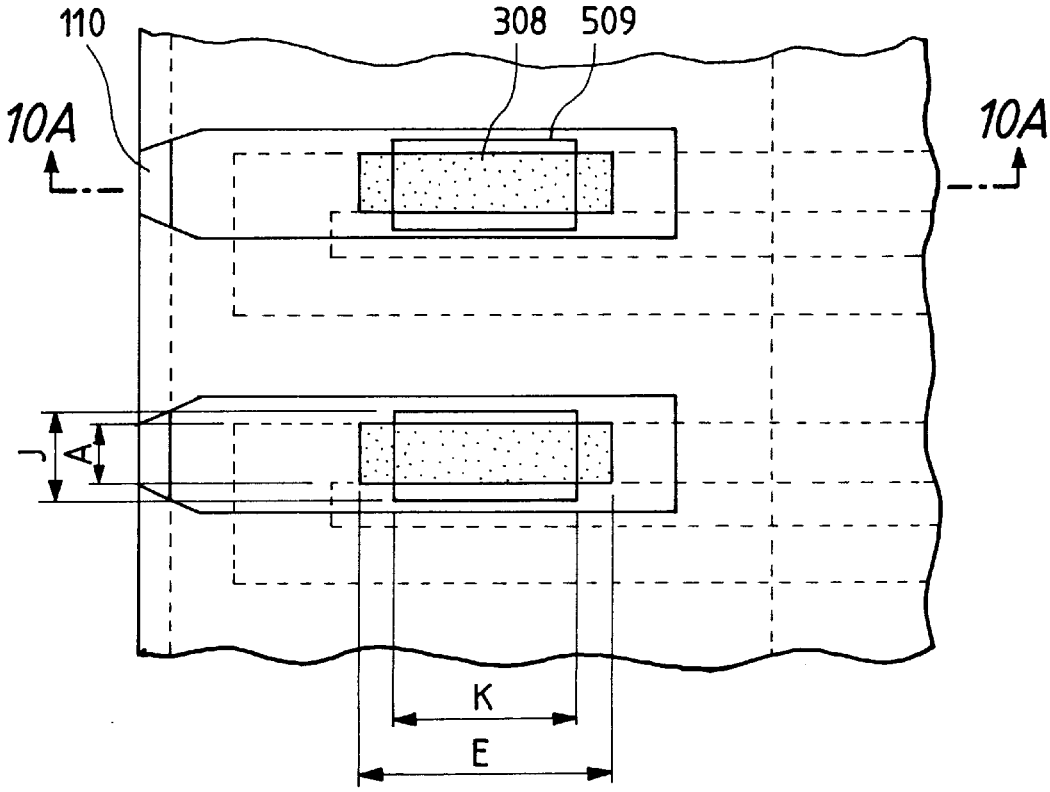

An ink-jet recording head having a constitution shown in FIGS. 10A and 10B was produced in the same manner as in Examples 20 to 26 except that the heat-generating portion was made in a shape as shown in FIGS. 10A and 10B with the dimension A of 20 μm.

Evaluation of Thermal Stress Durability (CST method)

The heater boards were evaluated according to a CST method by measuring the time passed before breakdown (disconnection). The longer the time passed before breakdown, the higher the thermal stress durability.

Ink-jet heads were driven under the running conditions below, and the number of pulses applied before breakdown (breakdown pulse number) was measured as the index of the time passed before breakdown; driving voltage: 1.2 times the bubble formation voltage, driving pulse width: 3.0 μsec, driving frequency: 3.0 kHz.

The evaluation results are represented by a relative value of the breakdown pulse number to that of the head of Reference Example taken as 1, as shown in Tables 1 to 5.

Evaluation by Discharge Durability Test

The ink-jet recording heads were filled with an ink, and practical ink discharge test was conducted. The time passed before breakdown was measured. The driving conditions were as follows; driving frequency: 3 kHz, driving pulse width: 3 μsec, driving voltage: 1.2 times the bubble formation voltage, ink composition: 77% by weight of water, 12% by weight of diethylene glycol, 7% by weight of urea, and 4% by weight of a dye (C.I. Food Black 2).

The results are shown in Table 6. The time passed before breakdown are represented by a relative value to that of the head of Reference Example 2 taken as 1.

TABLE 1

| | Dimension A (μm) | Dimension B (μm) | Breakdown pulse number (Relative value) |
|---|---|---|---|
| Example | | | |
| 1 | 20 | 30 | 6000 |
| 2 | 20 | 55 | 700 |
| 3 | 30 | 50 | 4000 |
| 4 | 20 | 50 | 5000 |
| 5 | 20 | 40 | 5000 |
| 6 | 20 | 22 | 500 |
| 7 | 20 | 25 | 2000 |
| Comparative Example 1 | 20 | 20 | 1 |

TABLE 2

| | Dimension F (μm) | Dimension G (μm) | Breakdown pulse number (Relative value) |
|---|---|---|---|
| Example | | | |
| 8 | 0.1 | 0.2 | 5000 |
| 9 | 0.05 | 0.07 | 9000 |
| 10 | 0.1 | 0.25 | 300 |
| 11 | 0.1 | 0.15 | 7000 |
| 12 | 0.1 | 0.11 | 400 |
| 13 | 0.1 | 0.12 | 4000 |
| Comparative Example 1 | 0.1 | 0.1 | 1 |

TABLE 3

| | Dimension H (μm) | Dimension I (μm) | Breakdown pulse number (Relative value) |
|---|---|---|---|
| Example | | | |
| 14 | 2.0 | 0.7 | 6000 |
| 15 | 2.0 | 0.2 | 500 |
| 16 | 1.0 | 0.5 | 4000 |
| 17 | 2.0 | 1.8 | 700 |
| Comparative Example 1 | 2.0 | 2.0 | 1 |

TABLE 4

| | Material | Breakdown pulse number (Relative value) |
|---|---|---|
| Example | | |
| 18 | $Si_3N_4$ | 5000 |
| 19 | $Al_2O_3$ | 3000 |
| Comparative Example 1 | $SiO_2$ | 1 |

TABLE 5

| | Dimension A (μm) | Dimension B (μm) | Breakdown pulse number (Relative value) |
|---|---|---|---|
| Example | | | |
| 20 | 20 | 30 | 8000 |
| 21 | 20 | 55 | 900 |
| 22 | 30 | 50 | 5000 |
| 23 | 20 | 50 | 7000 |
| 24 | 20 | 40 | 8000 |
| 25 | 20 | 22 | 900 |
| 26 | 20 | 25 | 3000 |
| Comparative Example 2 | 20 | 20 | 1 |

TABLE 6

| | Time before Breakdown (Relative value) |
|---|---|
| Example | |
| 1 | 8000 |
| 8 | 6000 |
| 14 | 5000 |
| 18 | 5000 |
| 20 | 5000 |
| Comparative Example | |
| 1 | 2 |
| 2 | 1 |

What is claimed is:

1. An ink-jet recording head comprising an ink flow path having a discharge opening for discharging an ink, an electrothermal transducer provided corresponding to the ink flow path and comprising a lower layer for heat accumulation, a resistance layer provided on the lower layer, and a pair of wiring electrodes provided on the resistance layer for applying an electric signal to the resistance layer, a portion of the resistance layer being disposed between the wiring electrodes and forming a heat-generating portion; and a protective layer provided on the electrothermal transducer for protecting the electrothermal transducer, the protective layer having on the heat-generating portion a thin portion of a thickness smaller than the thickness of a thick portion which is an other portion of the protective layer, wherein the heat-generating portion has a high temperature section having a pair of end portions and a pair of low temperature sections each provided contiguous to and in contact with an associated said end portion of the high temperature section, the high temperature section and the pair of low temperature sections together having a continuous flat surface, wherein the thin portion of the protective layer is positioned on the high temperature section, and wherein a boundary portion of the protective layer at which the thin portion is continuous to the other portion to vary the thickness is positioned on the low temperature section.

2. The ink-jet recording head according to claim 1, wherein the low temperature section is provided by making nonuniform a width of the resistance layer forming the heat-generating portion.

3. The ink-jet recording head according to claim 1, wherein the low temperature section is provided by making nonuniform the thickness of the resistance layer forming the heat-generating portion.

4. The ink-jet recording head according to claim 1, wherein the low temperature section is provided by making nonuniform the thickness of the lower layer corresponding to the heat-generating portion.

5. A ink-jet recording head according to claim 1, wherein the low temperature section is provided by making nonuniform the thermal conductivity of the lower layer corresponding to the heat-generating portion.

6. The ink-jet recording head according to any one of claims 1 to 5, wherein the boundary portion at which the thickness of the protective layer varies is a boundary between the thin portion and the thick portion of the protective layer.

7. The ink-jet recording head according to any one of claims 1 to 5, wherein the boundary portion at which the thickness of the protective layer varies is a boundary between a region having the protective layer and a region having no protective layer.

8. An ink-jet recording apparatus comprising:

the ink-jet recording head of claims 1 to 5; and means for delivering a recording medium.

9. An ink-jet recording head comprising:

an ink flow path having a discharge opening for discharging an ink;

an electrothermal transducer provided corresponding to the ink flow path and comprising a lower layer for heat accumulation, the lower layer having a thickness, a resistance layer provided on the lower layer and having a width and a thickness, and a pair of wiring electrodes provided on the resistance layer for applying an electric signal to the resistance layer, a portion of the resistance layer being disposed between the wiring electrodes and forming a heat-generating portion; and a protective layer provided on the electrothermal transducer for protecting the electrothermal transducer, the protective layer covering a part of the heat-generating portion and having a thickness, wherein the protective layer has on the heat-generating portion a thin portion of a thickness smaller than the thickness of a thick portion which is an other portion of the protective layer, wherein the heat-generating portion has a high temperature section having a pair of end portions and a pair of low temperature sections each provided contiguous to and in contact with an associated said end portion of the high temperature section, the high temperature section and the pair of low temperature sections together having a continuous flat surface, wherein the thin portion of the protective layer is positioned on the high temperature section, and wherein a boundary portion of the protective layer at which the thin portion is continuous to the other portion to vary the thickness is positioned on the low temperature section, and wherein a part of the heat-generating portion covered by the protective layer is located within a low temperature section of the heat-generating portion, and the protective layer also covers the wiring electrodes.

10. The ink-jet recording head according to claim 9, wherein the low temperature section is provided by making nonuniform the width of the resistance layer forming the heat-generating portion.

11. The ink-jet recording head according to claim 9, wherein the low temperature section is provided by making nonuniform the thickness of the resistance layer forming the heat-generating portion.

12. The ink-jet recording head according to claim 9, wherein the low temperature section is provided by making nonuniform the thickness of the lower layer corresponding to the heat-generating portion.

13. A ink-jet recording head according to claim 9, wherein the low temperature section is provided by making nonuniform a thermal conductivity of the lower layer corresponding to the heat-generating portion.

14. The ink-jet recording head according to any one of claims 9–13, wherein the boundary portion at which the thickness of the protective layer varies is a boundary between the thin portion and the thick portion of the protective layer.

15. The ink-jet recording head according to any one of claims 9 to 13, wherein the boundary portion at which the thickness of the protective layer varies is a boundary between a region having the protective layer and a region having no protective layer.

the ink-jet recording head of any claims 1 to 5; and means for delivering a recording medium.

* * * * *

UNITED STATES PATENT AND TRADEMARK OFFICE

CERTIFICATE OF CORRECTION

PATENT NO. : 6,042,221
DATED : March 28, 2000
INVENTOR(S) : Hirokazu Komuro

It is certified that error appears in the above-identified patent and that said Letters Patent is hereby corrected as shown below:

Drawing, Sheet 9,
FIG. 9A and FIG. 9B, replace FIG. 9A and 9B with the attached FIG. 9A and 9B.

Drawing Sheet 10,
FIG. 10A and FIG. 10B, replace FIG. 10A and 10B with the attached FIG. 10A and 10B.

Column 5,
Line 21, "a" (2nd occurrence) should read -- an --.

Column 9,
Line 57, "region" should read -- regions --.

Column 18,
Line 30, "an other" should read -- another --.

Column 20,
Line 19, "A" should read -- An --;
Line 20, Lines 32 and 33 should be deleted.

Signed and Sealed this

Fourth Day of December, 2001

*Attest:*

Nicholas P. Godici

*Attesting Officer*

FIG. 9A - PRIOR ART
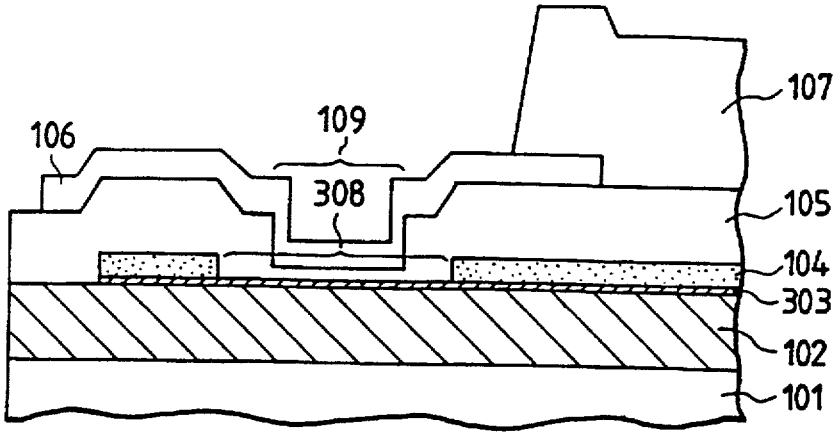
FIG. 9B - PRIOR ART
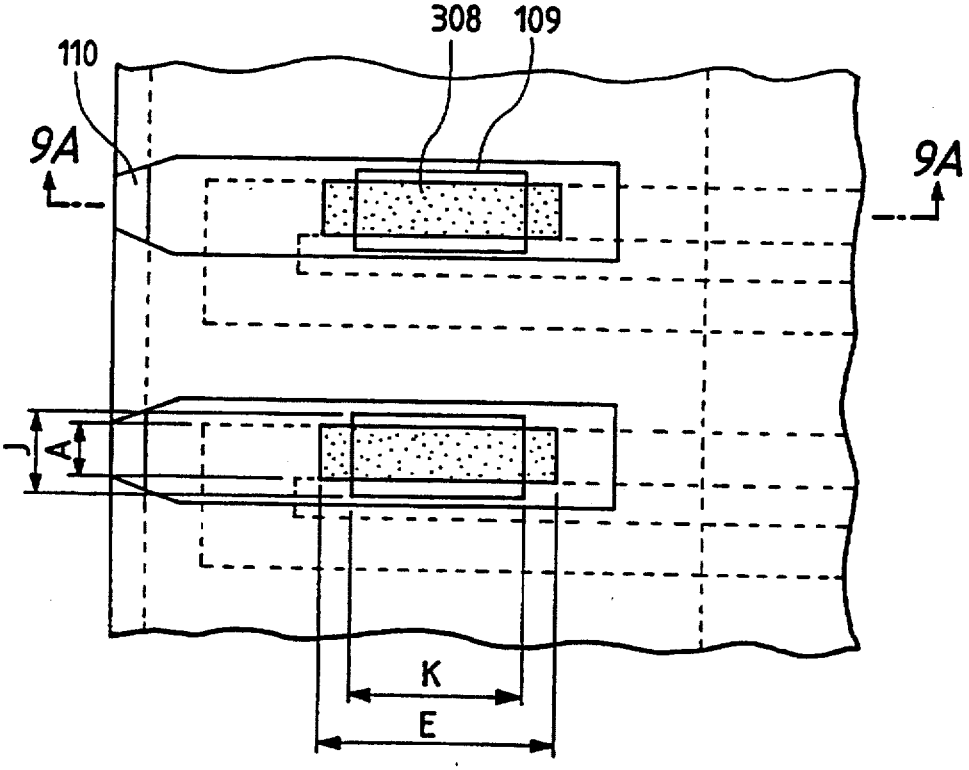

FIG. 10A - PRIOR ART
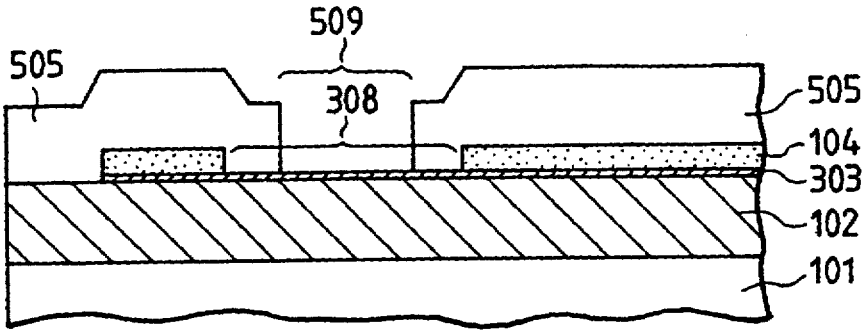
FIG. 10B - PRIOR ART
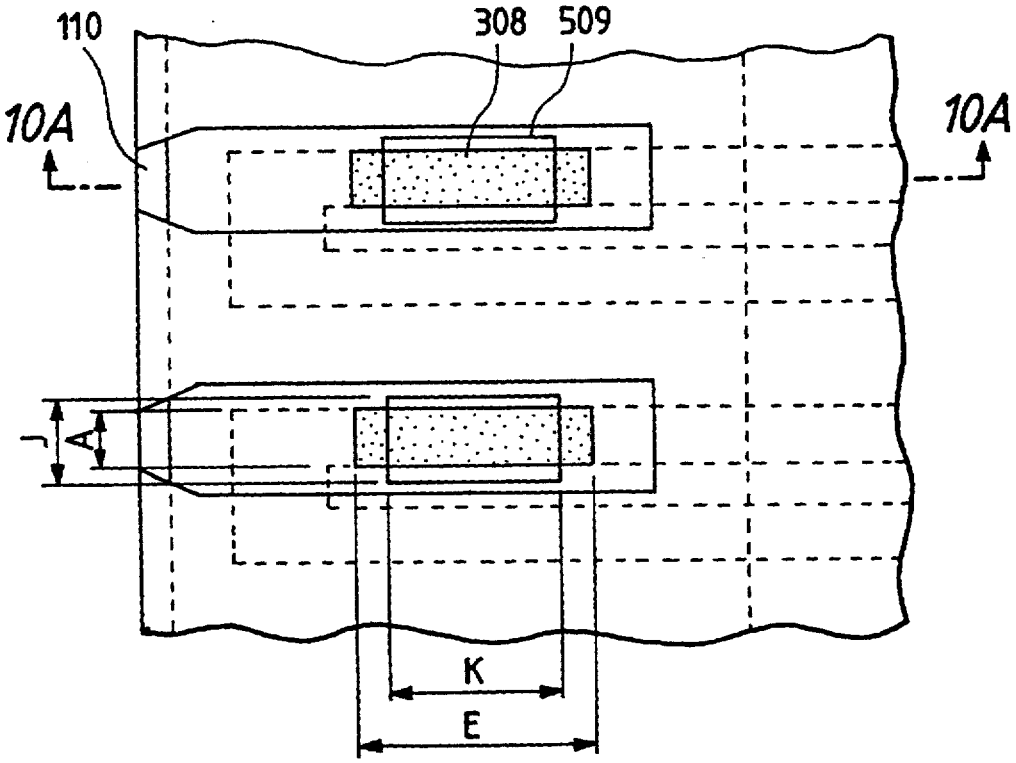

NICHOLAS P. GODICI
*Acting Director of the United States Patent and Trademark Office*